US011358688B2

(12) United States Patent
Liu et al.

(10) Patent No.: US 11,358,688 B2
(45) Date of Patent: Jun. 14, 2022

(54) METHOD AND SYSTEM FOR DETERMINING SAFE UNDER KEEL CLEARANCE OF ULTRA-LARGE SHIP

(71) Applicant: Wuhan University of Technology, Wuhan (CN)

(72) Inventors: Jingxian Liu, Wuhan (CN); Yong Ma, Wuhan (CN); Zhao Liu, Wuhan (CN); Haisen Tong, Wuhan (CN); Yanmin Xu, Wuhan (CN); Huanhuan Li, Wuhan (CN)

(73) Assignee: WUHAN UNIVERSITY OF TECHNOLOGY, Wuhan (CN)

( * ) Notice: Subject to any disclaimer, the term of this patent is extended or adjusted under 35 U.S.C. 154(b) by 182 days.

(21) Appl. No.: 16/918,131

(22) Filed: Jul. 1, 2020

(65) Prior Publication Data

US 2021/0221484 A1 Jul. 22, 2021

(30) Foreign Application Priority Data

Jan. 17, 2020 (CN) ..... 202010053486.0

(51) Int. Cl.
*B63B 79/10* (2020.01)
*B63B 79/40* (2020.01)
*B63B 79/15* (2020.01)

(52) U.S. Cl.
CPC ..... *B63B 79/40* (2020.01); *B63B 79/15* (2020.01)

(58) Field of Classification Search
CPC ..... B63B 79/10; B63B 79/15; B63B 39/12; B63B 79/40; B63B 43/18; B63B 201/26; B63B 49/00; G01C 13/008; G01C 21/00; G01C 21/20; G01C 21/22; G01C 5/00;
(Continued)

(56) References Cited

U.S. PATENT DOCUMENTS 5,545,063 A * 8/1996 Haynes ..... B63H 11/103 440/47
6,439,148 B1 * 8/2002 Lang ..... B63B 1/288 114/61.12

(Continued)

OTHER PUBLICATIONS

Guo et al., The calculation method of DUKC for ultra large-scale ships in restricted waters, 2019, IEEE, p. 324-328 (Year: 2019).*

(Continued)

*Primary Examiner* — McDieunel Marc
(74) *Attorney, Agent, or Firm* — Cantor Colburn LLP

(57) ABSTRACT

A method and a system for determining a safe under keel clearance of an ultra-large ship are provided. The method comprises: acquiring operation parameter values of the ship; obtaining fluid pressure according to the values; obtaining a squat force and a trim moment of the ship according to the pressure; establishing a mirror image model based on speed potential to establish a squat clearance calculation model for the ship; determining a half-wave rising height with above calculation model; obtaining draught and trim changes according to the squat force and the trim moment, to determine a maximum squat clearance of the hull; determining the safe under keel clearance; and controlling the squat clearance of the ship according to the safe under keel clearance of the ship, to avoid navigation dangers, and improve the loading rate.

8 Claims, 4 Drawing Sheets

(58) Field of Classification Search
CPC ..... G08G 3/02; B63G 8/38; B63J 2099/008; Y10S 367/909
See application file for complete search history.

(56) References Cited

U.S. PATENT DOCUMENTS

| | | | | |
|---|---|---|---|---|
| 2002/0152941 | A1* | 10/2002 | Kay | B63B 1/04 114/61.16 |
| 2006/0156744 | A1* | 7/2006 | Cusiter | F17C 5/06 62/53.2 |
| 2008/0029014 | A1* | 2/2008 | Giles | B63B 1/34 114/289 |
| 2015/0217844 | A1* | 8/2015 | Firkan | B63G 8/00 440/12.5 |
| 2015/0336643 | A1* | 11/2015 | Keuning | B63J 2/04 114/284 |

OTHER PUBLICATIONS

Tong et al., Study on impact factors and calculation model of UKC in Bohai Sea, 2017, IEEE, p. 1166-1169 (Year: 2017).*
Ivče et al., Method for improving container ship's squat prediction using optical fiber technology, 2012, IEEE, p. 271-274 (Year: 2012).*
Jeon et al., Designing Algorithms to Assess Collision Riskin Coastal Waters, 2019, IEEE, p. 1-4 (Year: 2019).*

* cited by examiner

METHOD AND SYSTEM FOR DETERMINING SAFE UNDER KEEL CLEARANCE OF ULTRA-LARGE SHIP

CROSS REFERENCE TO RELATED APPLICATION

This application claims the benefit of priority of Chinese Patent Application No. 202010053486.0, entitled "Method and System for Determining Safe Under Keel Clearance of Ultra-Large Ship" filed with the China National Intellectual Property Administration on Jan. 17, 2020, which is incorporated herein by reference in its entirety.

TECHNICAL FIELD

The disclosure relates to the field of calculating an under keel clearance of a ship, in particular to a method and a system for determining a safe under keel clearance of an ultra-large ship.

BACKGROUND ART

With a rapid development of international trade and a booming waterway transportation, a traffic flow of the waterway transportation is also increasing rapidly, the difficulty in waterway transportation organization is increasing gradually, and the total number of waterway accidents is increasing year by year. There are many kinds of accidents, with the major one being collision accidents, which leads to huge losses to shipping enterprises, transportation maritime departments and related auxiliary shipping enterprises.

Under Keel Clearance (UKC) is a water depth clearance that must be reserved at the bottom of a ship when the ship navigates through a shoal or in a shallow water area, which is a basic factor to prevent the ship from bottom dragging, grounding, stranding and losing control. When the ship sails on the shallow water area, due to a change in a flow field around the ship, the ship sinks, the trim changes and maneuverability deteriorates. In order to avoid dangerous situations such as bottom dragging, grounding, stranding and losing control, a safe distance between the bottom of the ship and the bottom of the water, i.e. the value of the under keel clearance, must be fully considered.

At present, the method for researching the safe under keel clearance of the ultra-large ship is mainly based on experience values, which does not consider a dynamic draught part of the ship in navigation, especially in shallow water.

SUMMARY OF THE INVENTION

The disclosure intends to provide a method and a system for determining a safe under keel clearance of an ultra-large ship, which can not only avoid navigation dangers of the ship, but also improve a loading rate of the ultra-large ship, by controlling a squat of the ship.

In order to achieve the above effect, the disclosure provides the following solutions:

A method for determining the safe under keel clearance of the ultra-large ship comprises the steps of:

acquiring operation parameter values of the ultra-large ship;

obtaining fluid pressure according to the operating parameter values of the ultra-large ship;

obtaining a squat force and a trim moment of the ultra-large ship according to the fluid pressure;

establishing a mirror image model based on a velocity potential;

establishing a squat clearance calculation model for an ultra-large ship according to the established mirror image model based on the velocity potential;

determining a rising height of a half-wave according to the squat clearance calculation model for the ultra-large ship;

obtaining a draught change and a trim change according to the squat force and the trim moment;

determining a maximum squat clearance of the hull according to the draught change and the trim change;

acquiring a difference between salt water and fresh water, increased draught by heeling, and reduced draught by an oil-water consumption;

determining the safe under keel clearance of the ship according to the difference between the salt water and the fresh water, the increased draught by heeling, the reduced draught by the oil-water consumption , the rising height of the half-wave and the maximum squat clearance of the hull; and controlling the squat clearance of the ultra-large ship according to the safe under keel clearance of the ship.

Optionally, the obtaining the fluid pressure according to the operating parameter values of the ultra-large ship specifically comprises:

obtaining the fluid pressure by a formula $p=\rho(U\phi_x-\frac{1}{2}\nabla\phi\cdot\nabla\phi+gz)$ according to the operating parameter values of the ultra-large ship;

wherein P is the fluid pressure, ρ is fluid density, g is gravity acceleration, U is ship speed, $\phi_x$ is perturbation velocity potential at any point, and $\nabla\phi$ is a gradient of the perturbation velocity potential.

Optionally, the obtaining the squat force and the trim moment of the ultra-large ship according to the fluid pressure specifically comprises the steps of:

obtaining the squat force to which the ultra-large ship is subjected, by a formula $$\vec{F}=(F_1, F_2, F_3)=\iint_{S_B} p\vec{n}_B dS$$

according to the fluid pressure; and obtaining the trim moment to which the ultra-large ship is subjected, by a formula $$\vec{M}=(M_1, M_2, M_3)=\iint_{S_B} p(\vec{r}\times\vec{n}_B)dS$$

according to the fluid pressure;

wherein, $\vec{r}=(x, y, z)$ is a vector from the origin of coordinates to any point on a wet hull surface $S_B$, $\vec{F}$ is a force applied to the hull along three coordinate axis directions, $\vec{M}$ is a force moment applied to the hull to rotate around the three coordinate axes, and $\vec{n}_B=(n_{B1}, n_{B2}, n_{B3})$ is a unit normal vector of the wet hull surface.

Optionally, the determining the rising height of a half-wave according to the squat clearance calculation model for the ultra-large ship specifically comprises:

calculating rising height of the wave surface according to the squat clearance calculation model for the ultra-large ship; and determining the rising height of the half-wave according to the rising height of the wave surface.

Optionally, the obtaining the draught change and the trim change according to the squat force and the trim moments specifically comprises:

obtaining the draught change and the trim change by a formula $$\begin{pmatrix} F - F_{30} \\ M - M_{20} \end{pmatrix} = \begin{pmatrix} \frac{\partial F}{\partial T} & \frac{\partial T}{\partial t} \\ \frac{\partial M}{\partial T} & \frac{\partial F}{\partial t} \end{pmatrix} \begin{pmatrix} \Delta T \\ \Delta t \end{pmatrix}$$

according to the squat force and the trim moment;

wherein, F30 is the squat force of the ship in a static floating state, M20 is the trim moment of the ship in the static floating state, F is the squat force of the ship at a kth iteration, M is the trim moment of the ship at the kth iteration, ΔT is an amount of the draught change, and Δt is an amount of the trim change.

Optionally, the determining the maximum squat clearance of the hull according to the draught change and the trim change specifically comprises:

determining an average squat clearance of the hull according to the draught change and the trim change; and obtaining the maximum squat clearance of the hull by $S_{max}=L_{pp}\cdot(S_M+0.5|t|)$ according to the average squat clearance of the hull;

wherein $L_{PP}$ is the length of the ship, t is the trim, $S_{max}$ is the maximum squat clearance of the hull, and $S_M$ is the average squat clearance of the hull.

Optionally, the determining the safe under keel clearance of the ship according to the difference between the salt water and the fresh water, the increased draught by heeling, the reduced draught by the oil-water consumption , the rising height of the half-wave and the maximum squat clearance of the hull specifically comprises:

determining the safe under keel clearance of the ship by a formula $H_{UKC}=\delta\rho+\Delta B+H_{1/2w}+\delta d+\text{Squat}$ according to the difference between the salt water and the fresh water, the increased draught by heeling, the reduced draught by the oil-water consumption , the rising height of the half-wave and the maximum squat clearance of the hull;

wherein $H_{UKC}$ is the safe under keel clearance of the ship, δρ is the difference between the salt water and the fresh water, ΔB is the increased draught by heeling, $H_{1/2w}$ is the rising height of the half-wave, $\delta_d$ is the reduced draught by the oil-water consumption, and Squat is the maximum squat clearance of the ship.

A system for determining a safe under keel clearance of an ultra-large ship comprises:

a first acquisition module configured to acquire operation parameter values of the ultra-large ship;

a fluid pressure determination module configured to obtain the fluid pressure according to the operation parameter values of the ultra-large ship;

a squat force/trim moment determination module configured to obtain the squat force and the trim moment of the ultra-large ship according to the fluid pressure;

a mirror image model establishing module configured to establish a mirror image model based on a velocity potential;

a squat clearance calculation model establishing module configured to establish a squat clearance calculation model for an ultra-large ship according to the established mirror image model based on the speed potential;

a half-wave rising height determination module configured to determine rising height of the half-wave according to the squat clearance calculation model for the ultra-large ship;

a draught/trim change determination module configured to obtain a draught change and a trim change according to the squat force and the trim moment;

a hull maximum squat clearance determination module configured to determine a maximum squat clearance of the hull according to the draught change and the trim change;

a second acquisition module configured to obtain a difference between salt water and fresh water, increased draught by heeling, and reduced draught by an oil-water consumption ;

a ship safe under keel clearance determination module configured to determine the safe under keel clearance of the ship according to the difference between the salt water and the fresh water, the increased draught by heeling, the reduced draught by the oil-water consumption , the rising height of the half-wave and the maximum squat clearance of the hull; and a loading rate determination module configured to control the squat clearance of the ultra-large ship according to the safe under keel clearance of the ship.

According to the specific embodiments provided by the disclosure, the disclosure provides the following technical effects:

The disclosure provides a method and a system for determining a safe under keel clearance of an ultra-large ship. The method comprises the steps of: acquiring operation parameter values of the ultra-large ship; obtaining fluid pressure according to the parameter values; obtaining the squat force and the trim moment of the ultra-large ship according to the fluid pressure; establishing a squat clearance calculation model for an ultra-large ship according to the established mirror image model based on a velocity potential; determining rising height of a half-wave according to the calculation model; obtaining draught and trim changes according to the squat force and the trim moment; determining a maximum squat clearance of the hull according to the draught and trim change; determining the safe under keel clearance according to the difference between the salt water and the fresh water, the increased draught by heeling, the reduced draught by the oil-water consumption , the rising height of the half-wave and the maximum squat clearance of the hull; and determining the loading rate of the ultra-large ship according to the safe under keel clearance of the ship. The navigation dangers of the ship can be avoided and the loading rate of the ultra-large ship can be improved by controlling the squat clearance of the ship according to the safe under keel clearance of the ship.

BRIEF DESCRIPTION OF THE DRAWINGS

In order to more clearly illustrate the embodiments of the present disclosure or technical solutions in the prior art, the accompanying drawings used in the embodiments will now be described briefly. It is obvious that the drawings in the following description are only some embodiments of the disclosure, and that those skilled in the art can obtain other drawings from these drawings without involving any inventive effort.

DETAILED DESCRIPTION OF THE EMBODIMENTS

In the following, the technical solutions in the embodiments of the present disclosure will be clearly and completely described with reference to the drawings in the embodiments of the present disclosure. Obviously, the described embodiments are only a part of the embodiments of the present disclosure, but not all the embodiments. Based on the embodiments of the present disclosure, all other embodiments obtained by a person of ordinary skill in the art without involving any inventive effort are within the scope of the present disclosure.

The disclosure intends to provide a method and a system for determining a safe under keel clearance of an ultra-large ship, which can not only avoid navigation dangers of the ship by controlling a squat clearance of the ship, but also improve a loading rate of the ultra-large ship.

To further clarify the above objects, features and advantages of the present disclosure, a more particular description of the disclosure will be rendered by reference to the accompanying drawings and specific embodiments thereof.

Figure 1:
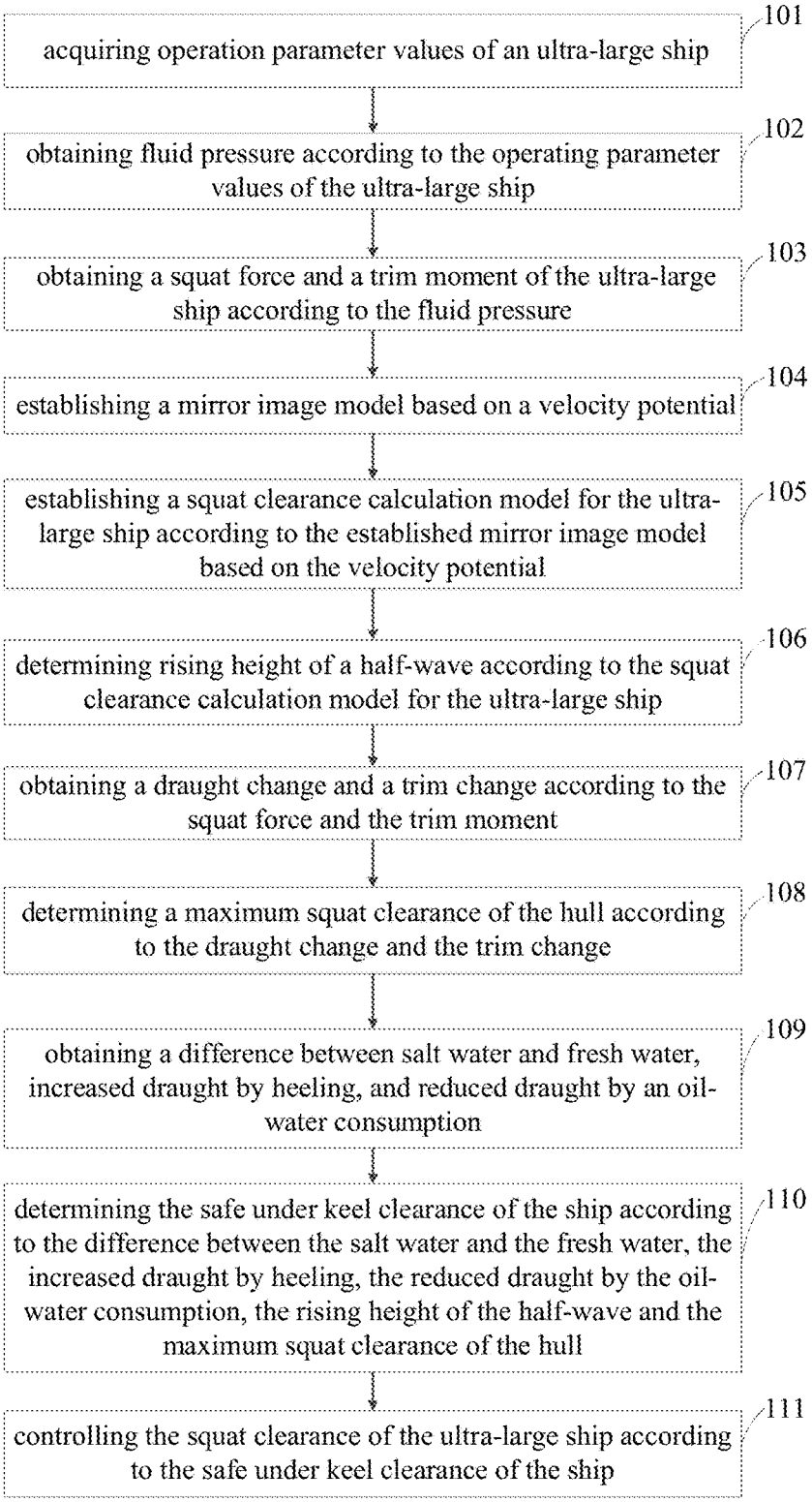
FIG. 1 is a flow chart of a method for determining a safe under keel clearance of an ultra-large ship according to the present disclosure.
Figure 2:
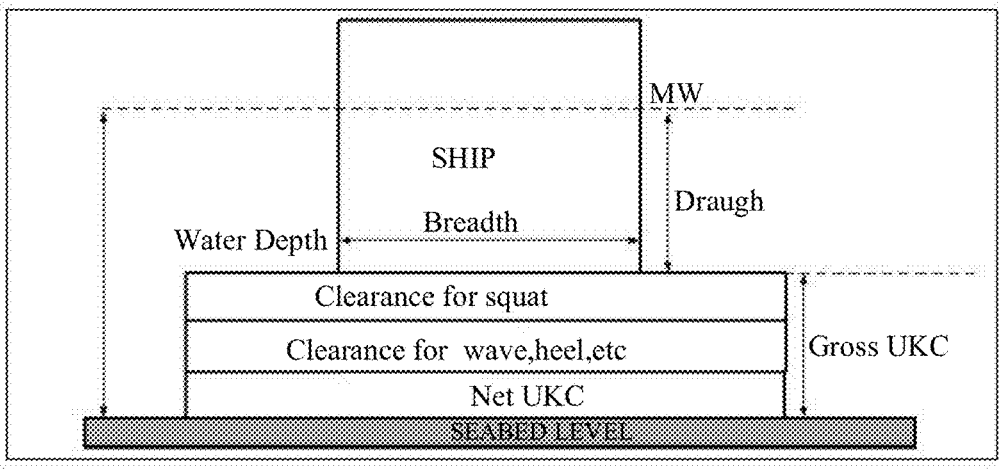
FIG. 2 is a schematic view of the under keel clearance according to the present disclosure.
Figure 3:
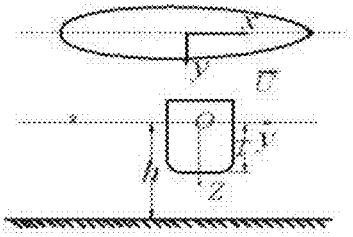
FIG. 3 is a schematic view of the ship navigating in shallow water according to the present disclosure.
Figure 4:
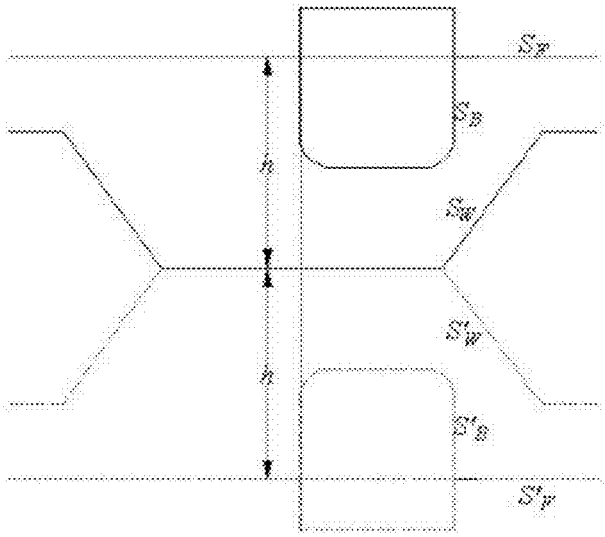
FIG. 4 is a schematic view of mirror image of a free surface, a hull surface and bulkhead wall surface with respect to a water bottom according to the present disclosure.
Figure 5:
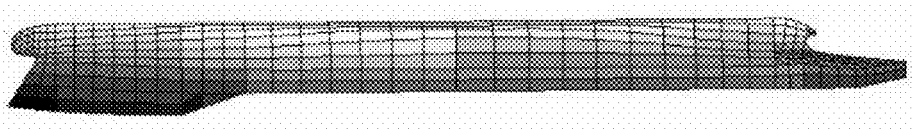
FIG. 5 is a schematic view of meshing of the hull surface according to the present disclosure.
Figure 6:
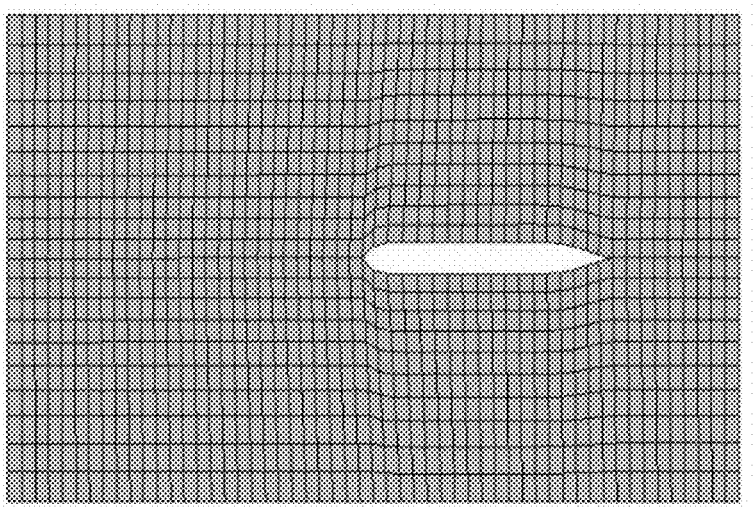
FIG. 6 is a view of meshing of the free surface of the ship at a design speed according to the present disclosure.

FIG. 1 is a flow chart of a method for determining the safe under keel clearance of the ultra-large ship according to the present disclosure. FIG. 2 is a schematic view of the under keel clearance according to the present disclosure. FIG. 3 is a schematic view of the ship navigating in shallow water according to the present disclosure. FIG. 4 is a schematic view of mirror image of a free surface, a hull surface and bulkhead wall surface with respect to a water bottom according to the present disclosure. FIG. 5 is a schematic view of meshing of the hull surface according to the present disclosure. FIG. 6 is a view of meshing of the free surface of the ship at a design speed according to the present disclosure. As shown in FIG. 1, the method for determining a safe under keel clearance of an ultra-large ship comprises steps of:

Step 101: acquiring operation parameter values of the ultra-large ship; the operation parameter values of the ultra-large ship comprise ship draught, water depth, ship speed and environmental factors, wherein the environmental factors comprise fluid density and wind speed.

Step 102: obtaining fluid pressure according to the operating parameter values of the ultra-large ship, specifically comprising:

obtaining the fluid pressure by a formula $p=\rho(U\phi_x-\frac{1}{2}\nabla\phi\cdot\nabla\phi+gz)$ according to the operating parameter values of the ultra-large ship;

wherein P is the fluid pressure, ρ is fluid density, g is gravity acceleration, U is ship speed, $\phi_x$ is perturbation velocity potential at any point, and $\nabla\phi$ is gradient of the perturbation velocity potential.

It is considered that the ship travels forward in shallow water at a constant speed U. A right-handed rectangular coordinate system o-xyz is adopted, wherein the o-xy plane coincides with a static water surface, the x axis points to the prow, the y axis points to a starboard of the hull, the z axis is vertically downward, h is water depth, and T is draught.

If the fluid is an incompressible ideal fluid with irrotational flow, a perturbation velocity potential φ (x, y, z) exists, and satisfies the Laplace equation in the flow field.

$$\nabla^2\phi=0 \tag{1}$$

Meanwhile, following boundary conditions are met on the boundary of the flow field:

(1) on the wet hull surface $S_B$:

$$\nabla\phi\cdot\vec{n}_B Un_{B1} \tag{2}$$

wherein, $\vec{n}_B=(n_{B1}, n_{B2}, n_{B3})$ is a unit normal vector of the wet hull surface.

(2) on the wet surface $S_W$ of the bulkhead wall:

$$\nabla\phi\cdot\vec{n}_W=0 \tag{3}$$

wherein $\vec{n}_W=(n_{W1}, n_{W2}, n_{W3})$ is a unit normal vector pointing to outside of the flow field on the wet surface of the bulkhead wall.

(3) on the water bottom z=h $$\phi_z=0 \tag{4}$$

In a free surface $S_F(z=\zeta(x, y))$, the comprehensive free surface boundary condition is as follows:

$$\nabla\phi\cdot\nabla(\tfrac{1}{2}\nabla\phi\cdot\nabla\phi)-2U\nabla\phi\cdot\nabla\phi_x+U^2\nabla\phi_{xx}-g\phi_z=0 \tag{5}$$

wherein, ζ is rising height of the free surface, g is gravity acceleration.

The attenuation condition is satisfied at infinity:

$$\nabla\phi|_{R\to\infty}=(0, 0, 0) \tag{6}$$

wherein $R=\sqrt{x^2+y^2+z^2}$.

Radiation conditions: φ should meet a condition of no wave in the far front of the ship .

A perturbation velocity potential φ is obtained by solving the above definite problem, so that the fluid pressure in the flow field can be obtained according to the Bernoulli equation:

$$p=\rho(U\phi_x-\tfrac{1}{2}\nabla\phi\cdot\nabla\phi+gz) \tag{7}$$

Wherein, ρ is fluid density.

Step 103: obtaining a squat force and a trim moment of the ultra-large ship according to the fluid pressure, specifically comprising:

obtaining the squat force to which the ultra-large ship is subjected, by a following formula according to the fluid pressure:

$$\vec{F}=(F_1, F_2, F_3)=\int_{S_B}\int p\vec{n}_B dS; \tag{8}$$

obtaining the trim moment to which the ultra-large ship is subjected, by a following formula according to the fluid pressure:

$$\vec{M}=(M_1, M_2, M_3)=\int_{S_B}\int p(\vec{r}\times\vec{n}_B)dS \tag{9}$$

wherein, $\vec{r}=(x, y, z)$ is a vector from the origin of coordinates to any point on a wet hull surface $S^B$, $\vec{F}$ is a force applied to the hull along three coordinate axis directions, $\vec{M}$ is a force moment applied to the hull to rotate around the three coordinate axes, and $\vec{n}_B=(n_{B1}, n_{B2}, n_{B3})$ is a unit nomral vector of the wet hull surface.

Step 104: establishing a mirror image model based on speed potential.

First-order three-dimensional panel method based on Rankine sources is used to solve the above boundary value problems. The velocity potential $\phi$ of any point P(x, y, z) in the flow field can be expressed by Rankine sources distributed on the boundary:

$$\phi(P) = -\frac{1}{4\pi}\iint_S \frac{\sigma(Q)}{r(P, Q)}dS; \tag{10}$$

wherein, $S=S_F+S_B+S_W+S_H+S_{28}$ is a boundary surface of the flow field; $S_F$ is a free surface; $S_B$ is the hull surface; $S_W$ is a bulkhead wall surface; $S_H$ is a water bottom surface; $S_\infty$ is a boundary surface at infinity; Q is a source point on the boundary surface; $\sigma(Q)$ is source strength at the point Q ; and r(P, Q) is a distance between a field point P and the source point Q.

The formula (10) automatically satisfies the Laplace equation and the perturbation attenuation condition at infinity $S_\infty$. Since the present disclosure only considers the case where the water bottom surface is a horizontal plane, the mirror image principle can be used, such that an original image and its mirror image with respect to the water bottom have the same source distribution. The formula (10) can therefore be rewritten as:

$$\phi(P) = -\frac{1}{4\pi}\iint_{SS'} \frac{\sigma(Q)}{r(P, Q)}dS \tag{11}$$

wherein, $SS'=S_F+S_B+S_W+S'_F+S'_B+S'_W$, $S'_F$, $S'_B$ and $S'_W$ are minor images of $S_F$, $S_B$ and $S_W$ with respect to the water bottom respectively.

Step 105: establishing a squat clearance calculation model for the ultra-large ship according to the established mirror image model based on the velocity potential;

The hull surface, the free surface and the bulkhead wall surface are discretized into $N_B$ surface elements, $N_F$ surface elements and $N_W$ surface elements respectively, assuming that source intensity on each surface element is a constant and the geometric mean point of the surface element is used as a configuration point. A discrete form of the velocity potential at any point P(x, y, z) in the flow field can be obtained from the formula (11):

$$\phi(x, y, z) = -\frac{1}{4\pi}\sum_{i=1}^{N}\sigma_i\left[\iint_{S_i}\frac{1}{r}dS + \iint_{S'_i}\frac{1}{r'}dS\right] \tag{12}$$

wherein $N=N_B+N_F+N_W$, $\sigma_i$ is the source intensity on the ith surface element, $S_i$ is a ith surface element, $S'_i$ is the mirror image of $S_i$ with respect to the water bottom, and r' is a distance from the mirror image point Q' of the source point Q with respect to the water bottom to the field point P.

Assuming $$G_i(x, y, z) = -\frac{1}{4\pi}\left[\iint_{S_i}\frac{1}{r}dS + \iint_{S'_i}\frac{1}{r'}dS\right],$$

the formula (12) can be rewritten as:

$$\phi(x, y, z) = \sum_{i=1}^{N}\sigma_i G_i(x, y, z) \tag{13}$$

The formula (13) is substituted into the formulas (11) and (12) to obtain:

$$\left(\sum_{i=1}^{N}\sigma_i\Delta G_i\right)\cdot\vec{n}_B = Un_{B1} \tag{14}$$

$$\left(\sum_{i=1}^{N}\sigma_i\Delta G_i\right)\cdot\vec{n}_W = 0 \tag{15}$$

Because the free surface condition is nonlinear and is satisfied on the unknown wave surface, Newton iteration method is used to satisfy the above conditions. The formulas (15) and (7) are rewritien as:

$$E(x,y,z;\sigma_i)=gz+U\phi_x-\tfrac{1}{2}\nabla\phi\cdot\nabla\phi=0 \tag{16}$$

$$F(x,y,z;\sigma_i)=\nabla\phi\cdot\nabla(\tfrac{1}{2}\nabla\phi\cdot\nabla\phi)-2U\nabla\phi\cdot\nabla\phi_x+U^2\nabla\phi_{xx}-g\phi_z 0 \tag{17}$$

Assuming that the approximate values of the $\zeta$ and $\sigma_i$ are Z and $A_i$ respectively at the kth iteration, a first-order Taylor expansion is performed on the formulas (16) and (17) at the approximate values to obtain:

$$E^{(k)} + (z - Z)E_z^{(k)} + \sum_{i=1}^{N}(\sigma_i - A_i)E_{\sigma_i}^{(k)} = 0 \tag{18}$$

$$F^{(k)} + (z - Z)F_z^{(k)} + \sum_{i=1}^{N}(\sigma_i - A_i)F_{\sigma_i}^{(k)} = 0 \tag{19}$$

$z$ is eliminated to obtain: (20)

$$F^{(k)} + E^{(k)}\frac{F_z^{(k)}}{E_z^{(k)}} + \sum_{i=1}^{N}(\sigma_i - A_i)\left(F_{\sigma_i}^{(k)} - E_{\sigma_i}^{(k)}\frac{F_z^{(k)}}{E_z^{(k)}}\right) = 0$$

wherein, the approximate values of $\zeta$ and $\sigma_i$ are Z and $A_i$ respectively, $E^{(k)}$ is the field strength after the kth iteration, $F^{(k)}$ is the squat force after the kth iteration, $F_z^{(k)}$ is the squat force after the kth iteration when the rising height of the wave surface is Z, and $E_z^{(k)}$ is the field strength after the kth iteration when the rising height of the wave surface is Z.

Step 106: determining rising height of a half-wave according to the squat clearance calculation model for the ultra-large ship specifically comprises following steps:

calculating the rising height of the wave surface according to the squat clearance calculation model for the ultra-large ship; and determining the rising height of the half-wave according to the rising height of the wave surface.

AN-order linear equation set is obtained by combining the $N_B$ equations on the hull, $N_W$ equations on the bulkhead wall and $N_F$ equations on the free surface corresponding to the simultaneous formulas (14), (15) and (20) respectively. The equation set is solved to obtain N unknown source strengths at the kth iteration. The rising height of the wave surface at current iteration is obtained by a formula (18) as follows:

$$\zeta = Z - \left[E^{(k)} + \sum_{i=1}^{N}(\sigma_i - A_i)E_{\sigma_i}^{(k)}\right]\frac{1}{E_z^{(k)}}.$$

Step 107: obtaining a draught change and a trim change according to the squat force and the trim moment, which specifically comprises:

obtaining the draught change and the trim change by a formula $$\begin{pmatrix} F - F_{30} \\ M - M_{20} \end{pmatrix} = \begin{pmatrix} \frac{\partial F}{\partial T} & \frac{\partial F}{\partial t} \\ \frac{\partial M}{\partial T} & \frac{\partial F}{\partial t} \end{pmatrix}\begin{pmatrix} \Delta T \\ \Delta t \end{pmatrix}$$

according to the squat force and the trim moment;

wherein, F30 is the squat force of the ship in a static floating state, M20 is the trim moment of the ship in the static floating state, F is the squat force of the ship at a kth iteration, M is the trim moment of the ship at the kth iteration, ΔT is an amount of the draught change, and Δt is an amount of the trim change.

Wherein $$\frac{\partial F}{\partial T} = \rho g A_w,\ \frac{\partial F}{\partial t} = -\rho g A_w x_x,\ \frac{\partial M}{\partial T} = \frac{\partial F}{\partial t},\ \text{and}\ \frac{\partial M}{\partial t} = \rho g\left(A_w x_w^2 + \nabla \overline{GM_L}\right);$$

$A_w$ is the area of the water plane; $x_w$ is a longitudinal coordinate of the centroid of the water plane; ∇ is a drainage volume; $\overline{GM_L}$ is a longitudinal metacentric height.

$$\overline{GM_L} \approx \frac{Iw}{\nabla},$$

wherein Iw is a longitudinal moment of inertia of the water plane with respect to the centre of flotation. Typically, the value of xw is approximately zero, so $$\frac{\partial F_z}{\partial t} = \frac{\partial M_y}{\partial T} \approx 0,\ \text{and}\ \frac{\partial M_y}{\partial t} = \rho g I_w.$$

Step 108: determining a maximum squat clearance of the hull according to the draught change and the trim change, specifically comprising:

determining an average squat clearance of the hull according to the draught change and the trim change; and obtaining the maximum squat clearance of the hull by $S_{max}=L_{pp}\cdot(S_M+0.5|t|)$ according to the average squat clearance of the hull;

wherein $L_{PP}$ is the length of the ship, t is the trim, $S_{max}$ is the maximum squat clearance of the hull, and $S_M$ is the average squat clearance of the hull.

Step 109: acquiring a difference between the salt water and the fresh water, increased draught by heeling, and reduced draught by the oil-water consumption, specifically comprising:

(1) calculating the difference between the salt water and the fresh water $$\delta\rho = \frac{\Delta}{100TPC}\left(\frac{\rho}{\rho_1} - \frac{\rho}{\rho_0}\right) \tag{21}$$

wherein, $\delta_\rho$ is the difference between the salt water and the fresh water in a unit of m; ∇ is displacement before entering a new water area, in a unit of t; TPC is a tunnage per centimeter of draught for standard seawater density at this displacement, in a unit of t/cm; ρ is the standard seawater density, and in general, ρ=1.025 g/cm3; $\rho_1$ is water density of a new water area; $\rho_0$ is water density of an original water area.

(2) calculating the increased draught by heeling

When a ship sails in a water area with limited water depth, the factor of the increased draught by heeling needs to be considered. The increased draught can be approximated by the following formula:

$$\Delta B = \frac{B\theta^o}{2\times 57.3} \approx \frac{B\theta^o}{120} \tag{22}$$

Wherein, ΔB is the increased draught by heeling in a unit of m; B is breadth in a unit of m.

When used, the following table is available for review.

TABLE 1

Increased draught at different heeling angles

| | Increased Draught at Different Heeling Angles (m) | | | | | |
|---|---|---|---|---|---|---|
| Breadth (m) | 0.5° | 1.0° | 1.5° | 2.0° | 2.5° | 3.0° |
| 15 | 0.065 | 0.131 | 0.196 | 0.262 | 0.327 | 0.393 |
| 20 | 0.087 | 0.175 | 0.262 | 0.349 | 0.437 | 0.524 |
| 25 | 0.109 | 0.218 | 0.327 | 0.437 | 0.546 | 0.655 |
| 30 | 0.131 | 0.262 | 0.393 | 0.524 | 0.655 | 0.786 |
| 35 | 0.153 | 0.305 | 0.458 | 0.611 | 0.764 | 0.917 |
| 40 | 0.175 | 0.349 | 0.524 | 0.698 | 0.873 | 1.047 |
| 45 | 0.196 | 0.393 | 0.589 | 0.785 | 0.982 | 1.178 |
| 55 | 0.218 | 0.436 | 0.654 | 0.873 | 1.091 | 1.309 |
| 60 | 0.240 | 0.480 | 0.720 | 0.960 | 1.200 | 1.440 |
| 65 | 0.262 | 0.524 | 0.785 | 1.047 | 1.309 | 1.571 |

(3) determining the reduced draught by the oil-water consumption

According to practical experiments, the ship is placed in still water; the oil and water are continuously reduced according to requirements to measure practically the reduced draught.

Step 110: determining the safe under keel clearance of the ship according to the difference between the salt water and the fresh water, the increased draught by heeling, the reduced draught by the oil-water consumption, the rising height of the half-wave and the maximum squat clearance of the hull, specifically comprising:

determining the safe under keel clearance of the ship by a formula $$H_{UKC} = \delta\rho + \Delta B + H_{\frac{1}{2}w} + \delta d + \text{Squat}$$

according to the difference between the salt water and the fresh water, the increased draught by heeling, the reduced draught by the oil-water consumption, the rising height of the half-wave and the maximum squat clearance of the hull;

wherein $H_{UKC}$ is the safe under keel clearance of the ship, $\delta_\rho$ is the difference between the salt water and the fresh water, ΔB is the increased draught by heeling, $$H_{\frac{1}{2}w}$$

is the rising height of the half-wave, δd is the reduced draught by the oil-water consumption, and Squat is the maximum squat clearance of the ship.

Step 111: controlling the squat clearance of the ultra-large ship according to the safe under keel clearance of the ship.

According to the disclosure, by collecting an operation parameter values of the ultra-large ship, area of the wet hull surface of an ultra-large ship is calculated, the mathematical model of the squat clearance of the large ship is established to calculate the squat clearance of the ship; according to the composition and influencing factors of the under keel clearance, based on the calculation and comprehensive measurement of the dynamic squat clearance of ships, the calculation models for the safe under keel clearance of different types of ultra-large ships under different sea conditions and different loading conditions are established by using the methods of analytical formula and semi-empirical formula, and the safe under keel clearance of the ships is determined according to the calculation model for the safe under keel clearance of the ships. According to the disclosure, the navigation dangers of the ship can be avoided by controlling the squat clearance of the ship, and the loading rate of the ultra-large ship can be improved.

Figure 7:
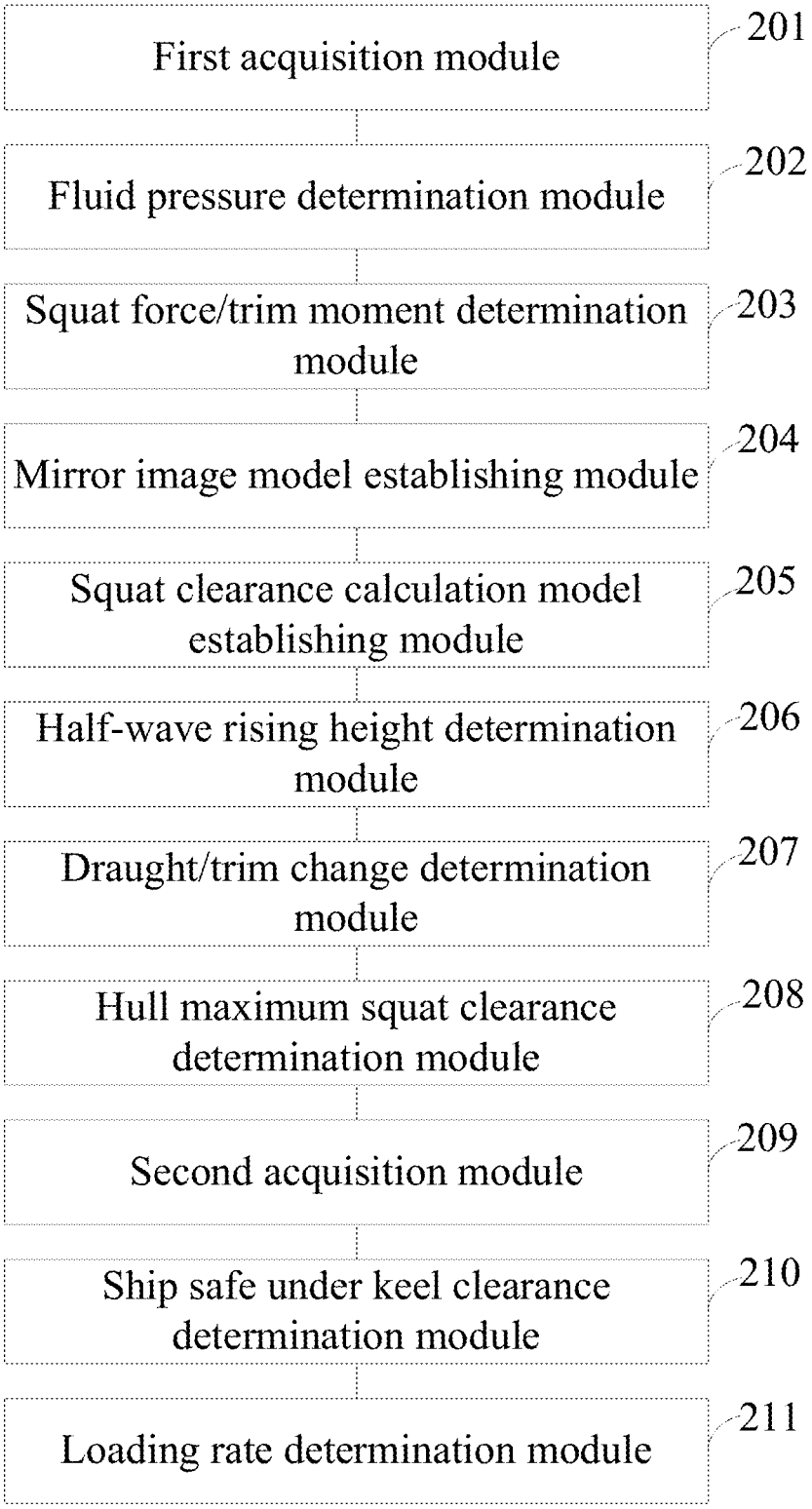
FIG. 7 is a block diagram of a system for determining the safe under keel clearance of the ultra-large ship according to the present disclosure.

FIG. 7 is a block diagram of a system for determining the safe under keel clearance of the ultra-large ship according to the present disclosure. As shown in FIG. 7, the system for determining a safe under keel clearance of an ultra-large ship comprises:

a first acquisition module 201 configured to acquire operation parameter values of the ultra-large ship;

a fluid pressure determination module 202 configured to obtain the fluid pressure according to the operation parameter values of the ultra-large ship;

a squat force/trim moment determination module 203 configured to obtain the squat force and the trim moment of the ultra-large ship according to the fluid pressure;

a mirror image model establishing module 204 configured to establish a mirror image model based on a speed potential;

a squat clearance calculation model establishing module 205 configured to establish a squat clearance calculation model for an ultra-large ship according to the established mirror image model based on speed potential;

a half-wave rising height determination module 206 configured to determine rising height of the half-wave according to the squat clearance calculation model for the ultra-large ship;

a draught/trim change determination module 207 configured to obtain a draught change and a trim change according to the squat force and the trim moment;

a hull maximum squat clearance determination module 208 configured to determine a maximum squat clearance of the hull according to the draught change and the trim change;

a second acquisition module 209 configured to obtain a difference between the salt water and the fresh water, increased draught by heeling, and reduced draught by the oil-water consumption;

a ship safe under keel clearance determination module 210 configured to determine the safe under keel clearance of the ship according to the difference between the salt water and the fresh water, the increased draught by heeling, the reduced draught by the oil-water consumption, the rising height of the half-wave and the maximum squat clearance of the hull; and a loading rate determination module 211 configured to control the squat clearance of the ultra-large ship according to the safe under keel clearance of the ship.

In this specification, various embodiments have been described in a progressive manner, with each embodiment being described with emphasis on differences from other embodiments, and the same and similar parts among various embodiments can be referred to each other. The system disclosed by the embodiment corresponds to the method disclosed by the embodiment and thus is briefly described, and the relevant parts can be explained with reference to the portion of the method.

The principles and implementation of the present disclosure have been described herein with specific examples, and the above embodiments are presented to aid in the understanding of the methods and core concepts of the present disclosure; meanwhile, those skilled in the art may make some changes in both the detailed description and the scope of application according to the teachings of this disclosure. In conclusion, the contents of the description should not be construed as limiting the disclosure.

What is claimed is:

1. A method for determining a safe under keel clearance of an ultra-large ship, comprising:

acquiring operation parameter values of the ultra-large ship;

obtaining fluid pressure according to the operating parameter values of the ultra-large ship;

obtaining a squat force and a trim moment of the ultra-large ship according to the fluid pressure;

establishing a mirror image model based on speed potential;

establishing a squat clearance calculation model for an ultra-large ship according to the established mirror image modelbased on a velocity potential;

determining a rising height of a half-wave according to the squat clearance calculation model for the ultra-large ship;

obtaining a draught change and a trim change according to the squat force and the trim moment;

determining a maximum squat clearance of the hull according to the draught change and the trim change;

acquiring a difference between salt water and fresh water, increased draught by heeling, and reduced draught by an oil-water consumption;

determining the safe under keel clearance of the ship according to the difference between the salt water and the fresh water, the increased draught by heeling, the reduced draught by the oil-water consumption, the rising height of the half-wave and the maximum squat clearance of the hull; and controlling the squat clearance of the ultra-large ship according to the safe under keel clearance of the ship.

2. The method for determining the safe under keel clearance of the ultra-large ship according to claim 1, wherein the obtaining the fluid pressure according to the operation parameter values of the ultra-large ship comprises:

obtaining the fluid pressure by a formula $p=\rho(U\phi_x-\frac{1}{2}\nabla\phi\cdot\nabla\phi+gz)$ according to the operation parameter values of the ultra-large ship;

wherein P is the fluid pressure, ρ is fluid density, g is gravity acceleration, U is ship speed, $\phi_x$ is perturbation velocity potential at any point, and $\nabla\phi$ is gradient of the perturbation velocity potential.

3. The method for determining the safe under keel clearance of the ultra-large ship according to claim 1, wherein the obtaining the squat force and the trim moment of the ultra-large ship according to the fluid pressure comprises:

obtaining the squat force to which the ultra-large ship is subjected, by a formula $$\vec{F}=(F_1, F_2, F_3)=\iint_{S_B} p\vec{n}_B dS$$

according to the fluid pressure; and obtaining the trim moment to which the ultra-large ship is subjected by a formula $$\vec{M}=(M_1, M_2, M_3)=\iint_{S_B} p(\vec{r}\times\vec{n}_B)dS$$

according to the fluid pressure;

wherein, $\vec{r}=(x, y, z)$ is a vector from the origin of coordinates to any point on a wet hull surface $S_B$, $\vec{F}$ is a force applied to the hull along three coordinate axis directions, $\vec{M}$ is a force moment applied to the hull to rotate around the three coordinate axes, and $\vec{n}_B=(n_{B1}, n_{B2}, n_{B3})$ is a unit normal vector of the wet hull surface.

4. The method for determining the safe under keel clearance of the ultra-large ship according to claim 1, wherein the determining the rising height of the half-wave according to the squat clearance calculation model for the ultra-large ship comprises:

calculating rising height of a wave surface according to the squat clearance calculation model for the ultra-large ship; and determining the rising height of the half-wave according to the rising height of the wave surface.

5. The method for determining the safe under keel clearance of the ultra-large ship according to claim 1, wherein the obtaining the draught change and the trim change according to the squat force and the trim moment comprises:

obtaining the draught change and the trim change by a formula $$\begin{pmatrix} F-F_{30} \\ M-M_{20} \end{pmatrix}=\begin{pmatrix} \frac{\partial F}{\partial T} & \frac{\partial F}{\partial t} \\ \frac{\partial M}{\partial T} & \frac{\partial F}{\partial t} \end{pmatrix}\begin{pmatrix} \Delta T \\ \Delta t \end{pmatrix}$$

according to the squat force and the trim moment;

wherein, $F_{30}$ is the squat force of the ship in a static floating state, $M_{20}$ is the trim moment of the ship in the static floating state, F is the squat force of the ship at a $k^{th}$ iteration, M is the trim moment of the ship at the $k^{th}$ iteration, ΔT is an amount of the draught change, and Δt is an amount of the trim change.

6. The method for determining the safe under keel clearance of the ultra-large ship according to claim 1, wherein the determining the maximum squat clearance of the hull according to the draught change and the trim change comprises:

determining an average squat clearance of the hull according to the draught change and the trim change; and obtaining the maximum squat clearance of the hull by $S_{max}=L_{PP}\cdot(S_M+0.5|t|)$ according to the average squat clearance of the hull;

wherein $L_{PP}$ is the length of the ship, t is the trim, $S_{max}$ is the maximum squat clearance of the hull, and $S_M$ is the average squat clearance of the hull.

7. The method for determining the safe under keel clearance of the ultra-large ship according to claim 1, wherein the determining the safe under keel clearance of the ship according to the difference between the salt water and the fresh water, the increased draught by heeling, the reduce draught by the oil-water consumption, the rising height of the half-wave and the maximum squat clearance of the hull comprises:

determining the safe under keel clearance of the ship by a formula $$H_{UKC}=\delta\rho+\Delta B+H_{\frac{1}{2}w}+\delta d+\text{Squat}$$

according to the difference between the salt water and the fresh water, the increased draught by heeling, the reduced draught by the oil-water consumption, the rising height of the half-wave and the maximum squat clearance of the hull;

wherein $H^{UKC}$ is the safe under keel clearance of the ship, $\delta_\rho$ is the difference between the salt water and the fresh water, ΔB is increased draught by heeling, $$H_{\frac{1}{2}w}$$

is the rising height of the half-wave, δd is the reduced draught by the oil-water consumption, and Squat is the maximum squat clearance of the ship.

8. A system for determining a safe under keel clearance of an ultra-large ship, comprising:

a first acquisition module configured to acquire an operation parameter values of the ultra-large ship;

a fluid pressure determination module configured to obtain the fluid pressure according to the operation parameter values of the ultra-large ship;

a squat force/trim moment determination module configured to obtain the squat force and the trim moment of the ultra-large ship according to the fluid pressure;

a mirror image model establishing module configured to establish a mirror image model based on a velocity potential;

a squat clearance calculation model establishing module configured to establish a squat clearance calculation model for the ultra-large ship according to the established mirror image model based on the speed potentia;

a half-wave rising height determination module configured to determine rising height of the half-wave according to the squat clearance calculation model for the ultra-large ship;

a draught/trim change determination module configured to obtain a draught change and a trim change according to the squat force and the trim moment;

a hull maximum squat clearance determination module configured to determine a maximum squat clearance of the hull according to the draught change and the trim change;

a second acquisition module configured to obtain a difference between salt water and fresh water, increased draught by heeling, and reduced draught by an oil-water consumption;

a ship safe under keel clearance determination module configured to determine the safe under keel clearance of the ship according to the difference between the salt water and the fresh water, the increased draught by heeling, the reduced draught by the oil-water consumption, the rising height of the half-wave and the maximum squat clearance of the hull; and a loading rate determination module configured to control the squat clearance of the ultra-large ship according to the safe under keel clearance of the ship.

* * * * *